US005704796A

United States Patent [19]

Swenson

[11] Patent Number: 5,704,796

[45] Date of Patent: Jan. 6, 1998

[54] TEARAWAY DUMMY PLUG FOR POWER CORD RECEPTACLES

[76] Inventor: Steven R. Swenson, P.O. Box 863, Saratoga, Calif. 95071-0863

[21] Appl. No.: 558,393

[22] Filed: Nov. 16, 1995

[51] Int. Cl.[6] ..... H01R 13/44

[52] U.S. Cl. ..... 439/148

[58] Field of Search ..... 439/148, 135, 439/134, 149

[56] References Cited

U.S. PATENT DOCUMENTS 3,387,252 6/1968 Rothweiler .
3,596,792 8/1971 Wilcox .
4,707,043 11/1987 Reed ..... 439/148
5,026,295 6/1991 Fong .

*Primary Examiner*—Khiem Nguyen
*Assistant Examiner*—Eugene G. Byrd
*Attorney, Agent, or Firm*—Fish & Richardson P.C.

[57] ABSTRACT

A tearaway dummy plug (10) for electronic assemblies with power receptacles giving evidence of the assemblies use. A dummy plug made of a single injection molded piece having pin grips (20 and 22) for griping the prong and a base (18) shaped for a snug fit with the housing when installed in the power cord receptacle. A pull tab (12) for pulling the dummy plug out of the receptacle. A tearaway region (14 and 16) formed as a weakness in the dummy plug to break when the tab (12) is pulled to remove the dummy plug from the receptacle.

12 Claims, 3 Drawing Sheets

TEARAWAY DUMMY PLUG FOR POWER CORD RECEPTACLES

FIELD OF THE INVENTION

This invention relates to dummy plugs for electrical receptacles that give evidence that an electrical unit has been used.

BACKGROUND

Tamper evident seals have been developed for many products from pharmaceuticals to beer kegs. Most concern themselves with the safety and freshness of a product. In general these are made of plastic in one form or another.

Wilcox U.S. Pat. No. 3,596,792 shows a tearaway injection molded closure for beverage containers. Annular bulges fit over the containers thread with shear line across the top to facilitate tearing. The closure is removed by grasping the tab tearing along the shear lines though a weakened section in the annular bulge releasing the cap.

Several dummy plugs have been developed to prevent contact with the terminals or prevent contamination of the receptacle. Rothweiler U.S. Pat. No. 3,387,252 shows a waterproof cover for electrical sockets. An elastomeric material is used to form a single member. This consisting of a ring to attached the closure to the socket and prongs attached to the closure to engage in the hole in the socket. Fong U.S. Pat. No. 5,026,295 shows a cover for an electrical connector. Projections at the ends provide guiding of the press fit cover into a header style connector. Projections in the middle of the cover and the flange position the cover above the connector pins.

Some electronics manufactures place an adhesive label across the receptacle opening to give evidence of use. These are perforated or very thin to make them difficult to remove in one piece. They often leave a residue of the adhesive resulting in a customer complaint.

OBJECTS AND ADVANTAGES

The present invention is tearaway dummy plug used with electronic assemblies having power cord receptacles. The dummy plug gives evidence of the assemblies' use. The tearaway dummy plug is a single injection molded low density polyethylene plastic piece having pin grips for gripping the prong and a base shaped for a snug fit with the housing when installed in the power cord receptacle. A pull tab attached at the base is used for pulling the dummy plug out of the receptacle. A tearaway region formed as a weakness in the dummy plug breaks when the tab is pulled to remove the dummy plug from the receptacle.

Among the advantages of the present invention are that it (a) provides a dummy plug that gives evidence of use or tampering;

(b) provides a dummy plug that cannot be reused without evidence of use;

(c) provides a dummy plug for power cord receptacles;

(d) provides a dummy plug that is inexpensive to produce; and (e) provides a dummy plug that leaves no residue.

Further advantages are that it provides a means of determining whether an electrical unit has been energized and requires testing upon return to the factory; and provides a dummy plug that requires no instructions to remove. Still further advantages will become apparent from a consideration of the ensuing description and drawings.

DETAILED DESCRIPTION

Figure 1:
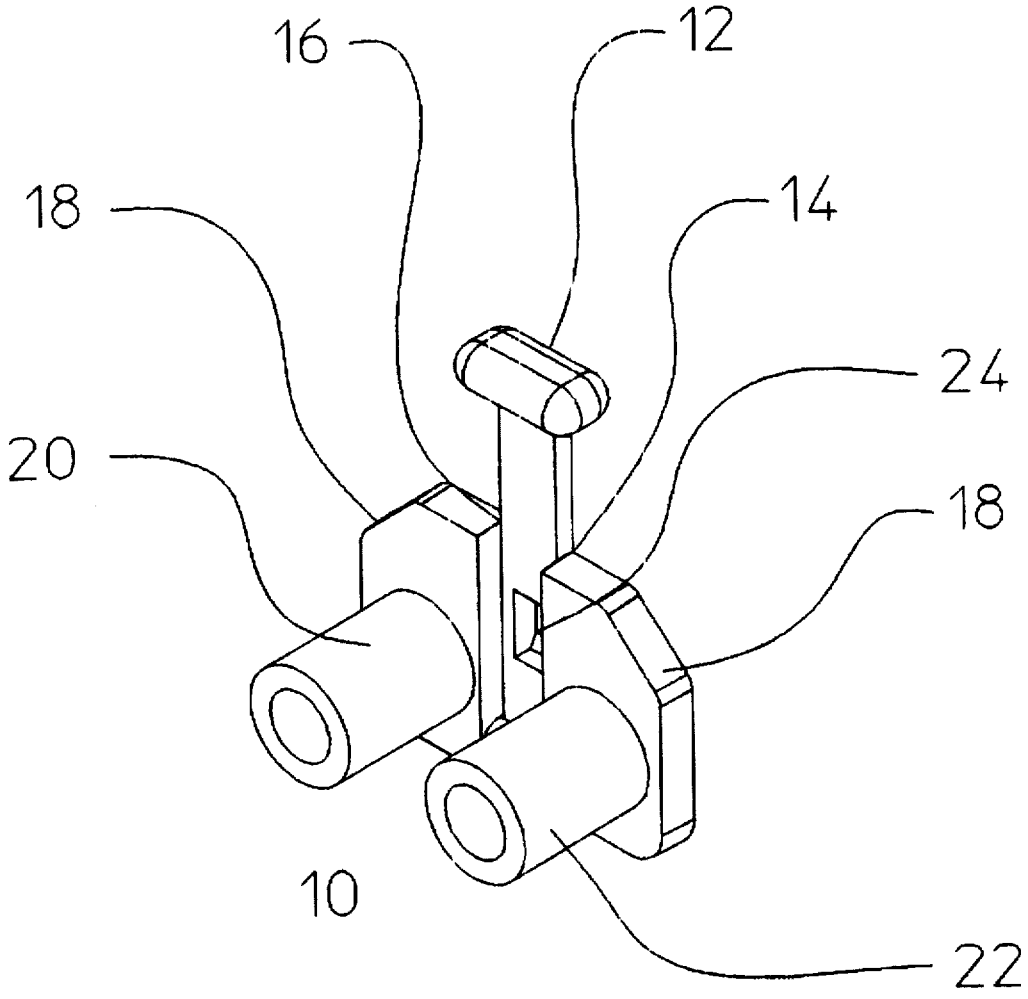
FIG. 1 shows a dummy plug.

Turning to FIG. 1, a dummy plug 10 is a single injection molded plastic piece. Pin grips 20 and 22 guide the plug into the socket and grip the pins tightly to prevent removal without tearing the shear lines 14 and 16. The grounding pin well 24 provides a stop to position the plug below the lip of the power cord receptacle housing 38 for a press fit. The sides of the body 18 aid in preventing the plug for being removed with out tearing.

Figure 2:
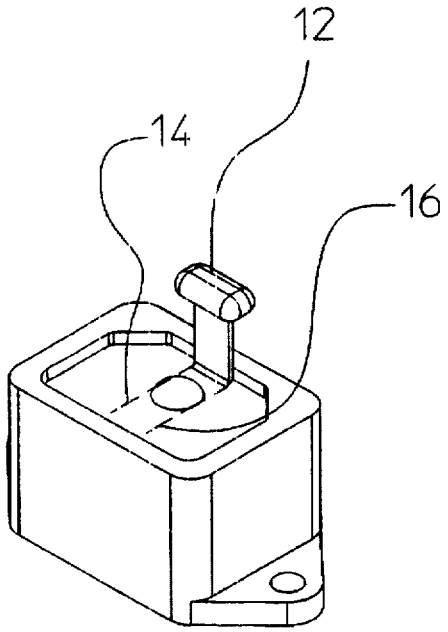
FIG. 2 shows a dummy plug installed in a power cord receptacle.

Installation is accomplished as shown in FIG. 2 by pushing the pin grips, 20 and 22, over the power pins 32 and 34 till the grounding pin 36 bottoms in the grounding pin well 24. The elastic properties of material allow the pull tab 12 to bend upwards without initiating the tear at the shear lines 14 and 16. Low density polyethylene with a thickness of 0.007 inches at the shear lines 14 and 16 works well.

Figure 3:
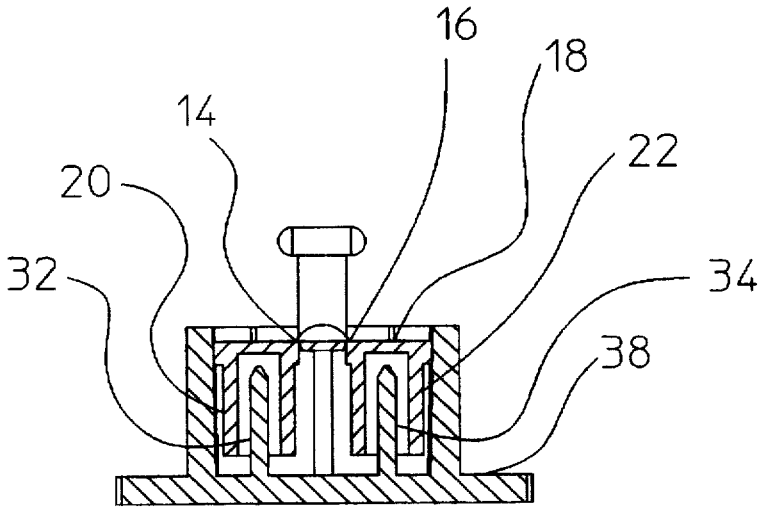
FIG. 3 shows a section view of a dummy plug installed in a power cord receptacle.

Turning to the section view FIG. 3, the interference fit of the pin grips, 20 and 22, and the power pins 32 and 34 along with the press fit of the sides of the body 18 and the sides of the power cord receptacle housing 38 hold the dummy plug 10 firmly in place. The weakened regions 14 and 16 are formed in a v-notch with 0.007 inches of material between the vertex of the v-notch and the top surface of the base 18.

Figure 4:
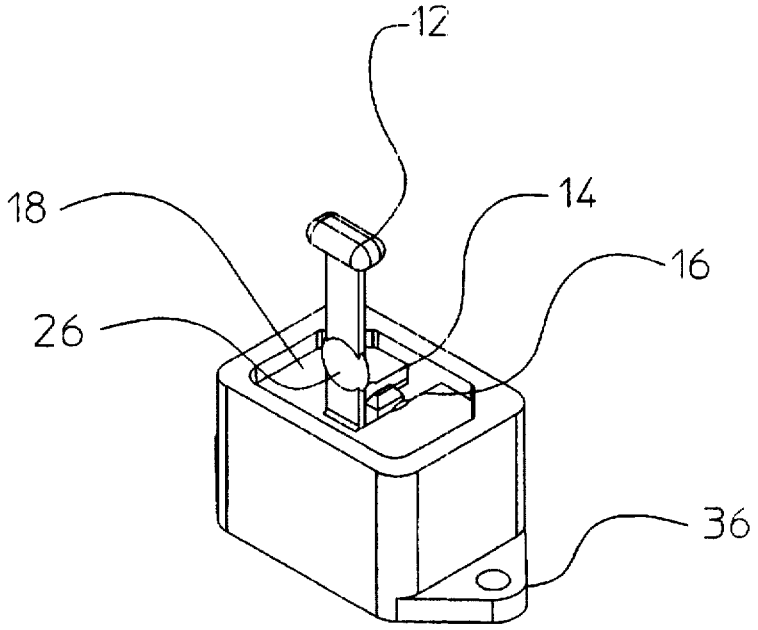
FIG. 4 and FIG. 5 show a dummy plug on removal from the power cord receptacle.
Figure 5:
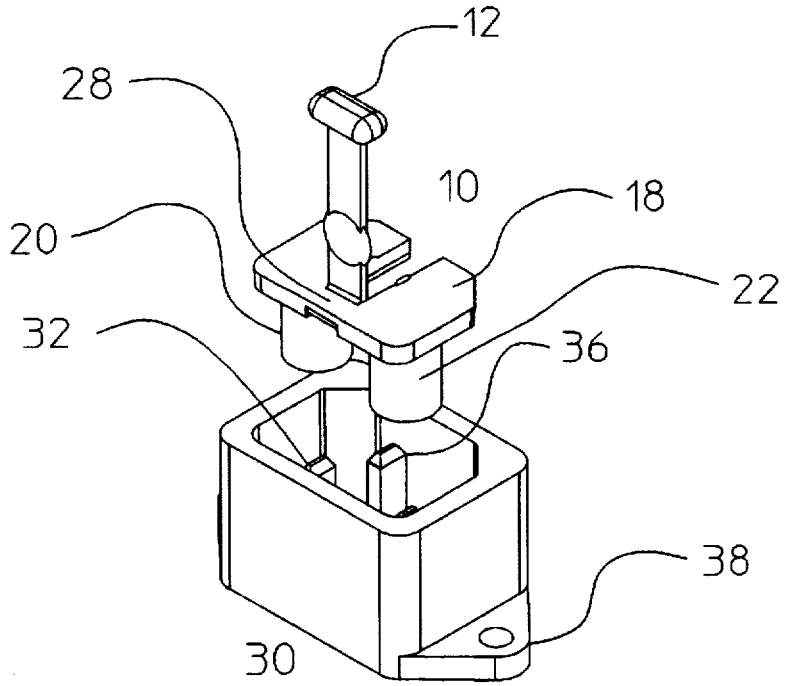

Removal is accomplished as shown in FIG. 4 and FIG. 5 by grasping the pull tab 12 and pulling upward tearing the plug along the shear line 14 and 16 to the body bridge 28. Continued upward pull slides the pin grips 20 and 22 off the power pins 32 and 34.

It is understood that the above described embodiments and applications are illustrative of the principles of the invention. Other arrangements may be devised without departing from the spirit and scope of the invention. For example, a cross section other than a circle may be used to grip or guide the dummy plug on the power pins. Only one pin may be gripped and still provide satisfactory results. Additionally, a dummy plug may grip only the sides of the receptacle housing with no pin grips to guide the plug over the pins.

Thus the scope of the invention should be determined by the appended claims and their legal equivalents, rather than by the embodiment given.

I claim:

1. A dummy plug for a power cord receptacle, the power cord receptacle having a housing enclosing a space and having in the enclosed space at least one prong accessible from an opening in the housing when the receptacle is not covered or in use, the dummy plug comprising:

a pin grip for guiding the dummy plug into the receptacle and for gripping the prong when the dummy plug is installed;

a tab which must be pulled to remove the dummy plug from the receptacle, the tab having a first, gripping end for being gripped by a person or a device, and a second, base end;

a base attached to the pin grip and to the base end of the tab and being shaped to fit snugly into the opening in the housing of the receptacle when the pin grip is guided over the prong; and a tearaway region formed as a weakness in the dummy plug to break when the tab is pulled by the gripping end to remove the dummy plug from the receptacle.

2. The dummy plug in claim 1 wherein the tearaway region is formed as a weak connection between the tab and the base, extending from about the gripping end to about the opposite end of the base.

3. The dummy plug of claim 1 wherein the dummy plug is injection molded.

4. The dummy plug of claim 1 wherein the dummy plug is made of a plastic material.

5. The dummy plug of claim 1 further comprising:

a second grip for griping a second prong of the receptacle; and a stop for limiting the depth of the installation of the dummy plug into the housing of the receptacle;

and wherein the tab and the base together form a substantially complete covering below the mouth of the opening to enclose with the housing the space defined by the housing, thereby blocking access to the prongs of the receptacle.

6. A dummy plug for a power cord receptacle, the power cord receptacle having a housing enclosing a space and having in the enclosed space at least one prong accessible from an opening in the housing when the receptacle is not covered or in use, the dummy plug comprising:

a tab which provides the sole means of pulling the dummy plug out of the receptacle, the tab having a first, gripping end for being gripped by a person or a device, and a second, base end;

a base attached to the base end of the tab and being shaped to grip the housing securely when installed in the opening in the housing of the receptacle; and a tearaway region formed as a weakness in the dummy plug to break when the tab is pulled by the gripping end to remove the dummy plug from the receptacle.

7. The dummy plug in claim 6 wherein the tearaway region is formed as a weak connection between the tab and base, extending from about the gripping end to about the opposite end of the base.

8. The dummy plug of claim 6 wherein the dummy plug is injection molded.

9. The dummy plug of claim 6 wherein the dummy plug is made of a plastic material.

10. The dummy plug of claim 6 wherein the tab and the base together form a substantially complete covering below the mouth of the opening to enclose with the housing the space, thereby blocking access to the prong of the receptacle.

11. The dummy plug of claim 6 wherein the dummy plug and the power cord receptacle are separate articles.

12. The dummy plug of claim 11 wherein the tearaway region is formed between the tab and the base.

* * * * *